US005104518A

United States Patent [19]

Jäger

[11] Patent Number: 5,104,518

[45] Date of Patent: * Apr. 14, 1992

[54] PROCESS FOR THE INHIBITION OF THE PUFFING OF COKES PRODUCED FROM COAL TAR PITCHES

[75] Inventor: Hubert Jäger, Biberbach-Eisenbrechtshofen, Fed. Rep. of Germany

[73] Assignee: Sigri GmbH, Meitingen, Fed. Rep. of Germany

[ * ] Notice: The portion of the term of this patent subsequent to Nov. 26, 2008 has been disclaimed.

[21] Appl. No.: 489,048

[22] Filed: Mar. 6, 1990

[30] Foreign Application Priority Data

Mar. 6, 1989 [DE] Fed. Rep. of Germany ..... 3907156

[51] Int. Cl.[5] ..... C10G 9/26

[52] U.S. Cl. ..... 208/125; 208/126; 208/131; 208/39; 208/44; 423/448; 423/449

[58] Field of Search ..... 208/125, 131; 423/449, 423/448; 264/29.1, 29.5

[56] References Cited

U.S. PATENT DOCUMENTS

| | | | |
|---|---|---|---|
| 2,814,076 | 10/1953 | Gartland | 264/29 |
| 2,922,709 | 1/1960 | Hitzell | 423/449 |
| 3,172,892 | 3/1965 | Suer et al. | 264/326 |
| 3,338,993 | 8/1967 | Juel et al. | 264/29 |
| 3,563,705 | 2/1971 | Grindstaff et al. | 264/209 |
| 3,642,962 | 2/1972 | Wallouch | 264/29 |
| 3,833,514 | 9/1974 | Wennerberg et al. | 423/449 |
| 3,835,033 | 9/1974 | Dregu et al. | 208/125 |
| 4,049,538 | 9/1977 | Hayashi et al. | 208/131 |
| 4,140,623 | 2/1979 | Sooter et al. | 208/125 |
| 4,233,138 | 11/1980 | Rollmann et al. | 208/125 |
| 4,271,204 | 8/1986 | Sakai et al. | 208/125 |
| 4,308,177 | 12/1981 | Tucker | 252/508 |
| 4,312,745 | 1/1982 | Hsu et al. | 208/125 |
| 4,334,980 | 6/1982 | Hsu | 208/125 |
| 4,370,223 | 1/1983 | Bose | 208/125 |
| 4,479,804 | 10/1984 | Chen et al. | 208/131 |
| 4,534,949 | 8/1985 | Glasser et al. | 423/449 |
| 4,661,240 | 4/1987 | Kessie et al. | 208/131 |
| 4,875,979 | 10/1984 | Orae et al. | 201/17 |

FOREIGN PATENT DOCUMENTS 733073 7/1955 United Kingdom .

OTHER PUBLICATIONS

13th Biennial Conference on Carbon, "Extended Abstracts and Program", Jul. 18-22, 1977; pp. 191-192.

16th Biennial Conference on Carbon "Extended Abstracts and Program", Jul. 18-22, 1983; pp. 595-596.

Carbon '80; Internation Journal of Research, vol. 13, No. 2, 1981; Wagner et al., "Irreversible Expansion and Shrinage During Graphitization of Isotropic Carbon Materials".

*Primary Examiner*—Helane Myers

*Attorney, Agent, or Firm*—Herbert L. Lerner; Laurence A. Greenberg

[57] ABSTRACT

Carbonates, oxides, carbides or fluorides of alkaline earth metals are added to coal tar pitches before coking. After the coking, which is preferably carried out by the delayed coking process, this produces coal tar pitch cokes or coal tar pitch needle cokes which have no irreversible expansion or a strongly reduced irreversible expansion upon heating in the temperature range of 1400° to 2000° C.

22 Claims, No Drawings

PROCESS FOR THE INHIBITION OF THE PUFFING OF COKES PRODUCED FROM COAL TAR PITCHES

The invention relates to a process for the inhibition of the irreversible volume expansion occurring in the temperature range of 1400° to 2000° C. with cokes produced from coal tar pitches.

The invention particularly relates to cokes which are to serve as raw material for the production of graphitized shaped bodies from carbon, which will be referred to as graphite bodies below. Such cokes are produced by thermal decomposition of hydrocarbons or hydrocarbon mixtures with a high carbon content, such as thermal tars, decant oils, pyrolysed oils, lubricating oil extracts or coal tar pitches under the predominant exclusion of air, and predominantly according to the delayed coking process. The chamber coking process is also used to a lesser extent. Graphite bodies have a good electrical and thermal conductivity, a high thermal shock resistance, corrosion resistance, mechanical strength and an outstanding temperature resistance. They are therefore used in large measure in electrothermal and electrochemical processes, as well as in process technology. The chief field of application is in the processing of electrosteel in which an arc burns between graphite electrodes with diameters up to 700 mm and lengths up to 2700 mm to produce melting heat.

The production of graphite bodies, which extends over a few weeks, requires several expensive process steps. The necessary raw materials are expensive. As a consequence of this, graphite bodies have a comparatively high price. One of the most important aims of the graphite producer is therefore to minimize production rejects and to produce products with high economic value. Graphite bodies are produced from coke, a carbonizable binder and optionally additions of auxiliaries. Dry starting materials are produced from the coke fractions obtained after grinding and sieving according to the compositions provided, these are mixed with a binder generally while hot and the mixture is shaped under compression, such as by extrusion presses, to form bodies. The shaped bodies are fired to form coke bodies at up to temperatures of 700° to 1000° C., with conversion of the binder material into a coke matrix, and the coke bodies are converted to graphite bodies in electric furnaces by heating to 2500° to 3000° C. Today, the most important raw materials for coke are petroleum cokes, especially the anisotropic premium petroleum cokes, which are also known as needle cokes due to the frequently observed structure thereof. The needle cokes have comparatively excellent properties such as a low thermal coefficient of expansion, low electric resistance, good mechanical strength and a high thermal conductivity. They are therefore used for the production of graphite bodies which are to withstand the highest stresses, like electrodes for Ultra High Power-electric melting furnaces.

In the last few years, high value cokes produced from coal tar pitch, so-called coal tar pitch needle cokes, have also become available. However, the production of large, loadable graphite bodies from such cokes is uneconomical because high rejection rates occur as a result of the formation of cracks upon graphitization.

The production of the premium cokes takes place according to the delayed coking process. In that process, high boiling hydrocarbon mixtures which are as aromatic rich as possible are heated in a furnace, most commonly a tubular furnace at about 500° C. and then are conveyed into coking drums in which the coking is carried out slowly over a time period of several hours. The process takes place with exclusion of air. After termination of the coking procedure, the green coke produced is removed from the coking drums and calcined at 1200° to 1400° C. The formation of the final pore system of the coke takes place in this process and the content of fluid substances drops to values less than 1%.

Apart from its structure, the usability of a coke depends on the raw materials and the processing conditions. It depends quite essentially on a phenomenon which those skilled in the art denote as "Puffing". This is understood to be a rapidly occurring irreversible volume expansion in the temperature range of 1400° to 2000° C. This puffing originates mechanical stresses in the shaped bodies produced from the cokes. Apart from leading to the formation of micro and macro cracks in the structure, the stresses also lead to rejects as a result of the body breaking open. Moreover, important properties of the graphite bodies, such as for example the mechanical strength, the electrical resistance and the thermal conductivity, are impaired. The puffing can be reduced by slower heating. However, this is uneconomical and also leads to losses in quality.

A source of the puffing with petroleum cokes is the sulphur content which lies between 0.3 and 1.5% with commercially available types. When the carbon shaped bodies pass through the temperature region of 1400° to 2000° C., e.g. upon graphitization, the sulphur is suddenly liberated in the form of gas and mechanical stresses which build up can lead to cracks as a consequence of the formation of a significant gas pressure in the bodies connected therewith. With petroleum cokes, there has been success in strongly reducing or suppressing the puffing by the addition of suitable inhibitors. The number of proposed puffing inhibitors is large and it is always a question of their being used in a fine distribution in the bodies to be graphitized. An essential disadvantage with the use of puffing inhibitors is that the thermal coefficient of expansion of the graphite is increased thereby. This impairs its resistance to temperature change and leads to a higher consumption of graphite with electrodes in steel works. It must therefore be an object to use as little as possible of a substance which is as effective as possible.

This problem is not easily solved and there have been a large number of proposals for this purpose.

German Published, Prosecuted Application DE-AS 1 073 368, corresponding to U.S. Pat. No. 2,814,076, describes the use of salts of the alkali metals, like sodium or potassium carbonate, as puffing inhibitors. The electrode blanks which are cooled after the firing, are impregnated with a sodium or potassium carbonate solution and then graphitized.

The addition of chromium oxide to a coke-pitch mixture is disclosed by French Patent No. 1,491,497. In addition to the inhibition of puffing, the additive acts as a graphitization catalyst.

In a process to be noted from British Patent No.733,073, oxides of chromium, iron, copper or nickel are added when grinding the coke and in this way are finely distributed over the surface of the coke in the subsequent mixing with pitch. They then act as puffing inhibitors upon graphitization of the shaped and fired bodies.

U.S. Pat. No. 3,563,705 teaches the addition of mixtures of iron or calcium compounds with small amounts of titanium and zirconium compounds to the mixture of coke and binder in order to prevent puffing.

U.S. Pat. No. 3,338,993 describes the addition of calcium, magnesium, strontium and barium fluorides to the mixture of green or calcined coke and the binder for the same purpose.

According to U.S. Pat. No. 4,308,177, additions of chlorinated naphthalenes also have a puffing inhibiting effect in addition to their action as a pressing auxiliary and condensation material for pitch. Especially strong effects inhibiting the puffing are produced with simultaneous addition of chloronaphthalenes and inhibiting metal compounds like iron, chromium, copper, cobalt or manganese oxide as well as alkaline earth metal fluorides to the mixture of production components before the shaping. The addition of 1 to 3% calcium cyanamide or calcium carbide as sulphur binding and puffing inhibiting agents to the green coke before calcining, is disclosed in U.S. Pat. No. 3,642,962.

U.S. Pat. Nos. 4,312,745 and 4,334,980 teach the production of cokes which have no puffing. For this purpose, chromium compounds, preferably chromium oxide (U.S. Pat. No. 4,312,745) or iron compounds, preferably iron oxide or calcium fluoride (U.S. Pat. No. 4,334,980) are added to a sulphur containing starting composition and then coke is produced by the delayed coking process. All of the known processes concern the addition of inhibitors in the production or working of petroleum cokes.

A particular problem is encountered with the use of cokes which have been produced from coal tar pitch.

Investigations (by K. W. Tucker et al at the 13th Biennial Conference on Carbon in Irvine, Calif., entitled Extended Abstracts, pages 191 and 192; and by I. Letizia and M. H. Wagner at the 16th Biennial Conference on Carbon in San Diego, Calif., also entitled Extended Abstracts, pages 593 and 594, as well as by E. G. Morris et al on pages 595 and 596 thereof) and experiences in technical processing have shown that the correlation existing for petroleum cokes between the level of sulphur content and the puffing is not valid for coal tar pitch cokes and that in particular the puffing of the coal tar pitch cokes and the coal tar pitch needle cokes as a result of the addition of the usual inhibiting materials for petroleum cokes, such as e.g. iron oxide or chromium oxide, cannot be reduced or cannot be reduced in sufficient measure. In practice, coal tar pitch cokes and coal tar pitch needle cokes show a marked puffing with sulphur contents which no longer give rise to any puffing with petroleum cokes. The puffing of petroleum coke is therefore not comparable with the puffing of cokes produced from coal tar pitches. The technical world therefore assumes that with cokes produced from coal tar pitches, besides sulphur, all other influencing factors such as nitrogen content, for example, are causes and they speak of an "anomalous puffing" of coal tar pitch cokes.

In spite of the availability of a large number of puffing inhibitors for petroleum cokes, this property of anomalous puffing has heretofore absolutely prevented the advantageous utilization of coal tar pitch cokes and of coal tar pitch needle cokes which are otherwise of equal value to premium petroleum cokes for the economical production of large size graphite shaped bodies such as e.g. electrodes for steel production, for reasons of availability and possession of raw material as well as for economic reasons.

It is accordingly an object of the invention to provide a process for the inhibition of the puffing of cokes, especially of coal pitch needle cokes produced from coal tar pitches, which overcomes the hereinafore-mentioned disadvantages of the heretofore-known methods of this general type, and to do so in such a way that they have no puffing or have puffing which is not damaging for the production of graphite bodies.

With the foregoing and other objects in view there is provided, in accordance with the invention, a process for the inhibition of the irreversible volume expansion occurring in the temperature range of 1400° to 2000° C. with cokes produced from coal tar pitch starting substances, which comprises adding at least one compound of metals from the group consisting of magnesium, calcium, strontium and barium, which is not soluble in the starting substances for the production of the coke, to the starting substances before or during coking.

In accordance with another mode of the invention, there is provided a process which comprises adding the at least one compound of metals from the group consisting of alkaline earth metal carbonates, alkaline earth metal oxides, alkaline earth metal carbides and alkaline earth metal fluorides individually or in mixtures with one another as additives.

The addition of these substances must take place in such a way that their uniform distribution over the quantity of substances specified for the coking is ensured, so that they are uniformly distributed later in each volume element of the coke and can then inhibit the puffing.

In accordance with a further mode of the invention, this is conveniently achieved by initially dispersing the inhibitor in a liquid which is miscible in a hydrocarbon substance (feedstock) specified for the coking and then adding to the feedstock by means of suitable conveying devices, such as continuously and in weight proportional amounts through metering pumps during the course of the process. Naturally, the inhibitors can be stirred into the feedstock in the corresponding amounts in a discontinuous or quasi discontinuous operation and afterwards can be kept in the suspension by continuous stirring or conveying procedures.

In accordance with an added mode of the invention, there is provided a process which comprises dissolving the inhibitors at least partially in a substance which can form salts or complex compounds with the alkaline earth metal salts and then metering them into the feedstock in the form of these solutions or by means of colloidal liquids produced by such dissolution process. Such substances are xanthates of the type $[R—OCSS]^-$, dithiophosphates of the type $[(RO)_2PSS]^-$, dithiocarbamates of the type $[R_2NCSS]^-$, mercaptans of the type RSH, thiocarbanalide $(C_6H_5NH)_2CS$, fatty acid salts of the type $[RCOO]^-$, alkyl or arylsulphonates of the type $[RSO_3]^-$, alkylsulphates of the type $[ROSO_3]^-$, primary ammonium salts of the type $RNH_3Cl$, quaternary ammonium salts of the type $RN(CH_3)_3Cl$, alkylpyridinium salts of the type $R(C_5H_4N)\cdot HCl$ and phenolates of the type $[(C_6H_5)—0]^-$ and alkyl or aryl substituted phenolates, wherein R is an aliphatic, an aromatic or a mixed aliphatic-aromatic residue with at least 6 C-atoms. Also found to be advantageous for this purpose are succinimide derivatives of the type

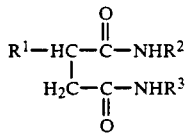

$R^1$ = e.g. polyisobutyl residue with at least 50 C-atoms
$R^2$, $R^3$ = ethylenepolyamine, e.g. diethylenetriamine or tetraethylenepentamine, the production of which has been described in U.S. Pat. No. 3,172,892 and which are available from Lubrizol Corporation, 29400 Lakeland Boulevard, Wickliff, Ohio 44092. The addition of the inhibitors to the feedstock can take place at different points in the procedure and with use of known metering and conveying devices. Therefore, in accordance with an additional mode of the invention, there is provided a process which comprises continuously adding inhibitors in weight related amounts to substances specified for the coking during conveying processes.

In accordance with again another mode of the invention, in the delayed coking process, this conveniently occurs in advance of the conveying configuration or pumps which convey the feedstock into a heater or tubular furnace.

Alternatively, in accordance with again a further mode of the invention, the addition is even possible, for example, at the heater section up to the entry into the coking drums, directly in the coking drums during the filling procedure or together with substances controlling the foaming in the coking drums. Moreover there are still further possibilities which are known to one skilled in the art and may be opportune if used.

In accordance with again an added mode of the invention, there is provided a process which comprises adding the at least one compound of metals until the content of alkaline earth metals corresponds to at least 0.02% by weight relative to the substances specified for the coking. The upper limit for the inhibitor being added depends upon the desired properties of the coke and must be determined by experiments. In general it is 1.0% by weight relative to the content of the respective alkaline earth metal in the feedstock.

In accordance with a concomitant mode of the invention, there is provided a process which comprises adding the at least one compound of metals with a fineness of at least 100% <50 micrometer and 50% <20 micrometer. This is done in order to obtain a distribution in the feedstock which is as fine as possible.

An advantage of the invention lies in the possibility of producing coal tar pitch cokes, especially premium coal tar pitch cokes, in which the puffing is controlled and which are suitable for the production of high loading graphite shaped bodies such as, for example, heavy duty electrodes for the electron steel process.

Other features which are considered as characteristic for the invention are set forth in the appended claims.

Although the invention is illustrated and described herein as embodied in a process for the inhibition of the puffing of cokes produced from coal tar pitches, it is nevertheless not intended to be limited to the details shown, since various modifications may be made therein without departing from the spirit of the invention and within the scope and range of equivalents of the claims.

The method of operation of the invention, however, together with additional objects and advantages thereof will be best understood from the following description of specific examples.

For each respective starting composition, finely powdered coal tar pitch suitable for the production of needle coke (alpha-resin 0.5%, beta-resin 31.2%, gamma-resin 29.0%, coke residue DIN 51905 : 54.1%, softening point DIN 52025 : 84.0° C.) was treated with one of the substances $Fe_2O_3$, $CaF_2$, MgO, MgO in a 1.5% suspension of a succinimide derivative of the types L 2153 of the firm Lubrizol and $BaCO_3$ in such an amount that the content of inhibitor metal in the coal tar pitch amounted to 1% by weight in each case. One starting composition remained for comparative purposes, without addition. Each of the starting compositions was mixed in a rapid mixer for uniform distribution of the inhibitors and then was heated in an annular chamber furnace to 1050° C. In this process, the temperature gradient in the coking phase amounted to 2 K/h. The coal tar pitch cokes thus produced did not differ, except for their puffing behavior, and had the following characteristic values:

Sulphur content DIN 51724 part 1 : 0.34±0.02%,
Hydrogen content DIN 51912 : 0.066±0.008%,
Density DIN 51901 : 2.122±0.004 g/cm$^3$,
Coefficient of linear thermal expansion (CTE) DIN 51909 : $0.35 \pm 0.05 \times 10^{-6} \times K^{-1}$.

For the production of test bodies, the cokes from the starting compositions were separately comminuted in an impact mill to a maximum particle size of 1 mm and then were mixed with 30 parts by weight of coal tar pitch (softening point DIN 52025 : 89° C., coking residue DIN 51905 : 59%, quinoline solubles DIN 51921 : 12%) relative to 100 parts by weight of coke for 20 minutes in a heatable Z-arm kneader at 130° C. The mixture was shaped at a composition temperature of 110° C. to block blanks of 50 mm diameter and 80 mm length. The firing of the blanks took place in a chamber furnace with a temperature gradient of about 4 K/h up to a temperature of 800° C.

Samples of measurements of 8×8×60 mm were cut from the coke bodies thus produced and dynamic puffing measurements in a temperature range of 1400° to 2400° C. were carried out with a high temperature torque rod dilatometer as described by M. H. Wagner et al in the article High Temperatures—High Pressures volume 13, page 153 (1981). The volume expansion totalled over the measuring range is indicated as a measure of the puffing. These values were obtained from the linear dilation values of the sample bodies according to Δ volume =3Δ length. The results are indicated in the Table below.

TABLE

| Inhibitor | Amount of Inhibitor metal in the pitch before coking [%] | | Δ Volume in the temperature range of 1400 to 2400° C. [%] |
|---|---|---|---|
| — | 0 | (Comparative) | 6.6 |
| $Fe_2O_3$ | Fe | 0.22 | 6.5 |
| $Fe_2O_3$ | Fe | 1.15 | 5.8 |
| $CaF_2$ | Ca | 1.04 | 2.4 |
| MgO | Mg | 1.05 | 2.3 |
| MgO [1)] | Mg | 1.01 | 2.1 |
| $BaCO_3$ | Ba | 1.05 | 0.9 |

[1)] as a combination MgO/succinimide derivative.

The values in the Table indicate the good effect of the metals of the alkaline earth group, in particular of barium, as puffing inhibitors with coal tar pitch cokes. Likewise significant is the failure of iron with coal tar pitch cokes, although it is effective as an inhibitor with petroleum cokes.

I claim:

1. Process for the inhibition of the irreversible volume expansion occurring in the temperature range of 1400° to 2000° C. with cokes produced from coal tar pitch starting substances, which consists essentially of adding at least one compound of metals from the group consisting of alkaline earth metals, which is not soluble in the starting substances for the production of the coke, to the starting substances at least as early as coking.

2. Process according to claim 1, which consisting essentially of adding the at least one compound of metals before coking.

3. Process according to claim 1, which consisting essentially of adding the at least one compound of metals during coking.

4. Process according to claim 1, which consisting essentially of adding the at least one compound of metals from the group consisting of alkaline earth metal carbonates.

5. Process according to claim 1, which consisting essentially of adding the at least one compound of metals from the group consisting of alkaline earth metal oxides.

6. Process according to claim 1, which consisting essentially of adding the at least one compound of metals from the group consisting of alkaline earth metal carbides.

7. Process according to claim 1, which consisting essentially of adding the at least one compound of metals from the group consisting of alkaline earth metal fluorides.

8. Process according to claim 1, which consisting essentially of adding several of the compounds of metals from the group consisting of alkaline earth metal carbonates, alkaline earth metal oxides, alkaline earth metal carbides and alkaline earth metal fluorides, in mixtures.

9. Process according to claim 1, which consisting essentially of adding the at least one compound of metals until the content of alkaline earth metals corresponds to 0.02 to 1.0% by weight relative to the substances specified for the coking.

10. Process according to claim 1, which consists essentially of adding the at least one compound of metals, with 100% having a grain size of less than 50 micrometer, and 50% having a grain size of less than 20 micrometer.

11. Process for the inhibition of the irreversible volume expansion occurring in the temperature range of 1400° to 2000° C. with cokes produced from coal tar pitch starting substances, which consists essentially of adding at least one compound of metals from the group consisting of alkaline earth metals, which is not soluble in the starting substances for the production of the coke, to the starting substances at least as early as coking and dissolving the at least one compound of metals in substances at least partially soluble in the substances specified for the coking before the addition thereof to the substances specified for the coking.

12. Process for the inhibition of the irreversible volume expansion occurring in the temperature range of 1400° to 2000° C. with cokes produced from coal tar pitch starting substances, which consists essentially of adding at least one compound of metals from the group consisting of alkaline earth metals, which is not soluble in the starting substances for the production of the coke, to the starting substances at least as early as coking and dispersing the at least one compound of metals in substances soluble in the substances specified for the coking before the addition thereof to the substances specified for the coking.

13. Process for the inhibition of the irreversible volume expansion occurring in the temperature range of 1400° to 2000° C. with cokes produced from coal tar pitch starting substances, which consists essentially of adding at least one compound of metals from the group consisting of alkaline earth metals, which is not soluble in the starting substances for the production of the coke, to the starting substances at least as early as coking and wetting the surface of the at least one compound of metals with substances soluble in the substances specified for the coking, before the addition thereof to the substances specified for the coking.

14. Process for the inhibition of the irreversible volume expansion occurring in the temperature range of 1400° to 2000° C. with cokes produced from coal tar pitch starting substances, which consists essentially of adding at least one compound of metals from the group consisting of alkaline earth metals, which is not soluble in the starting substances for the production of the coke, to the starting substances at least as early as coking and forming salts or complex compounds with the substances at least partially soluble in the substances specified for the coking and the metals from the group consisting of alkali and alkaline earth metal salts.

15. Process according to claim 23, wherein the step of adding inhibitors consists essentially of continuously adding inhibitors in weight related amounts to substances specified for the coking during conveying processes.

16. Process according to claim 23, wherein the step of adding inhibitors consists essentially of adding inhibitors to the substances specified for the coking upstream of a coking furnace when using a delayed coking process.

17. Process according to claim 23, wherein the step of adding inhibitors consists essentially of adding inhibitors to the substances specified for the coking upstream of a coking drum when using a delayed coking process.

18. Process according to claim 23, wherein the step of adding inhibitors consists essentially of adding inhibitors to the substances specified for the coking during pressing into a coking drum when using a delayed coking process.

19. Process for producing cokes from coal tar pitch starting substances, which consisting essentially of adding at least one compound of metals from the group consisting of magnesium, calcium, strontium and barium, which is not soluble in the starting substances for the production of the coke, to the starting substances at least as early as coking for inhibiting the irreversible volume expansion occurring in the temperature range of 1400° to 2000° C.

20. Process according to claim 19, which consisting essentially of adding the at least one compound of metals before coking.

21. Process according to claim 19, which consisting essentially of adding the at least one compound of metals during coking.

22. Process for the inhibition of the irreversible volume expansion occurring in the temperature range of 1400° to 2000° C. with cokes produced from coal tar pitch starting substances, which consists essentially of adding inhibitors and at least one compound of metals from the group consisting of alkaline earth metals, which is not soluble in the starting substances for the production of the coke, to the starting substances at least as early as coking.

* * * * *